US007652414B2

(12) United States Patent
Jaffrezic et al.

(10) Patent No.: US 7,652,414 B2
(45) Date of Patent: Jan. 26, 2010

(54) SPARK PLUG HAVING AN INDUCTIVE UPPER PORTION INCORPORATING A COIL WOUND AROUND AN ELASTICALLY DEFORMABLE CORE ELEMENT

(75) Inventors: Xavier Jaffrezic, Velizy (FR); Andre Agneray, Boulogne (FR)

(73) Assignee: Renault S.A.S., Boulogne Billancourt (FR)

( * ) Notice: Subject to any disclaimer, the term of this patent is extended or adjusted under 35 U.S.C. 154(b) by 31 days.

(21) Appl. No.: 11/993,930

(22) PCT Filed: Mar. 23, 2006

(86) PCT No.: PCT/FR2006/050257

§ 371 (c)(1),
(2), (4) Date: Jun. 9, 2008

(87) PCT Pub. No.: WO2006/136742

PCT Pub. Date: Dec. 28, 2006

(65) Prior Publication Data

US 2009/0050123 A1 Feb. 26, 2009

(30) Foreign Application Priority Data

Jun. 23, 2005 (FR) ..... 05 51729

(51) Int. Cl.
*H01T 1/16* (2006.01)
*H01T 1/00* (2006.01)
*H01T 1/24* (2006.01)

(52) U.S. Cl. ..... 313/143; 313/145; 313/137; 313/136; 123/169 EL

(58) Field of Classification Search ..... 313/118–145; 123/169 EL
See application file for complete search history.

(56) References Cited

U.S. PATENT DOCUMENTS 3,737,718 A * 6/1973 Rempes et al. ..... 313/136
3,871,349 A * 3/1975 Hager ..... 123/169 EL
3,882,341 A * 5/1975 Green ..... 313/134
4,029,990 A * 6/1977 Nagy et al. ..... 313/124

FOREIGN PATENT DOCUMENTS

FR 2 859 869 3/2005

OTHER PUBLICATIONS

U.S. Appl. No. 12/090,722, filed Apr. 18, 2008, Agneray, et al.
U.S. Appl. No. 12/093,547, filed May 13, 2008, Jaffrezic, et al.
U.S. Appl. No. 12/064,472, filed Feb. 22, 2008, Jaffrezic, et al.

* cited by examiner

*Primary Examiner*—Mariceli Santiago
(74) *Attorney, Agent, or Firm*—Oblon, Spivak, McClelland, Maier & Neustadt, L.L.P.

(57) ABSTRACT

A spark plug for an internal combustion engine of a motor vehicle; the spark plug is embodied with a generally essentially long shape and includes: an essentially capacitive lower part including two coaxial electrodes, one of which is a central electrode, and the other a threaded shell for screwing in the spark plug on the engine; and an essentially inductive upper part including a central winding including a plurality of coils wound around a coaxial mandrel, an envelope, and an insulator inserted between the envelope and the winding. The essentially capacitive part and the essentially inductive part are mechanically interconnected as to enable transmission of a clamping couple applied to the envelope to the essentially capacitive lower part. The mandrel can be elastically deformed as to compensate effects of dilation of the insulator.

9 Claims, 3 Drawing Sheets

SPARK PLUG HAVING AN INDUCTIVE UPPER PORTION INCORPORATING A COIL WOUND AROUND AN ELASTICALLY DEFORMABLE CORE ELEMENT

The invention relates to a spark plug for the internal combustion engine of a motor vehicle, of essentially long general shape, comprising:

an essentially capacitive lower portion comprising two coaxial electrodes, of which one is a central electrode and one is a threaded barrel for screwing the plug into the engine;

an essentially inductive upper portion comprising a central winding which comprises several coils wound round a coaxial core, a casing and an insulator placed between the casing and the winding, the essentially capacitive portion and the essentially inductive portion being connected together mechanically so as to allow the transmission of a tightening torque applied at the casing to the essentially capacitive lower portion.

The demands for increased efficiency and reduction of pollution place greater and greater constraints on the design of engines. The results of these constraints, in particular, for the ignition system, are smaller and smaller plug sizes, and a reduction of the radial dimensions of the plug access well, this, in order to be able, in particular, to increase the space available in the cylinder head to allow the passage of new cooling channels: the reduction of the space allocated to the plug and to its access well has led, among other things, to the production of "pencil" type coils placed directly in the plug access well.

Nevertheless, due, on the one hand, to the difference in service life between the plug itself and its coil, and, on the other hand, component standardization objectives (each type of engine actually requires a specifically suitable plug, whereas one type of plug coil may be common to several engine types), the plug and its coil are, most often, separate, and the only connection existing between them is then of an electrical type, the mechanical support of each of these two elements being provided independently, including in the case of the "pencil" coils mentioned previously.

Moreover, according to one fitting method well known in the prior art, the tightening torque of the plug is usually applied to the barrel of the plug, the barrel comprising, conventionally, a male thread intended to cooperate with a complementary female thread made in the cylinder head, and an element intended for the controlled tightening of the threaded assembly. Such a fitting method then requires the use of a special tool which is slid, around the coil and the plug, into the plug access well: such a configuration therefore requires, in particular, that there be, around the coil and in the plug access well, a free space which is not used apart from the plug fitting and removal operations. Now the existence of such a space works against the dimensional constraints previously mentioned.

In the text which follows, "lower" will refer to the portion of a spark plug intended to be nearest to the combustion chamber of an internal combustion engine, and "upper" the opposite portion of the plug.

Also, the "thin conductive layer" of a material having a high electrical conductivity will refer to a metal layer of a non-magnetic material with a thickness at least equal to or more than the film thickness in the frequency range concerned, that is to say between 1 megahertz and 10 megahertz, providing an electromagnetic screening function. The high conductivity of the materials will be similar to that of copper or silver, reference materials in this field.

Various fitting methods for fitting a plug and its coil are known, in which the spare reserved around the assembly for the passage of a tool intended for the mechanical fitting of the plug to the cylinder head of the engine is reduced to a minimum.

The document EP 1,249,907 thus presents, for example, a fitting method for a plug and its coil in which the plug access well is composed of a certain number of essentially cylindrical, concentric smooth holes, of which the respective diameters are adjusted so as to form at least one seat which is essentially perpendicular to the axis of the well, a bearing surface for the plug which is perpendicular to the common axis of the plug and the access well bearing on the seat, the positioning of the plug being carried out by means of a projecting element located on the lower portion of the plug and intended to cooperate with a complementary machined surface made in the walls of the access well. In the device presented in the document EP 1,249,907, a cap, composed of an essentially cylindrical tubular portion terminating in an essentially flat clamp of which the external diameter is wider than the diameter of the access well and of which the surface is essentially perpendicular to the axis of the tubular portion and the access well, is then placed over the upper portion of the plug. The dimensions of the cap are adjusted so that, when the essentially flat clamp is bearing on the upper face of the plug access well, the end of the tubular portion of the cap bears on a portion of the plug, thus holding the plug compressed in its access well: the tightening of the assembly is carried out by screwing the essentially flat clamp onto the upper face of the combustion chamber. In the device presented in the document EP 1,249,907, the coil is also incorporated in the cap, the electrical contact between the coil and the plug being made buy means of a helical spring which is compressed during the positioning of the cap Such a device, while it obviates the need to arrange a space specifically intended for the passage of a tightening tool into the plug access well, nevertheless requires the production of a large number of precision parts.

It is, in addition, not very suitable for radio-frequency plasma plugs, in particular due to the method of connection between the plug and its selected coil.

In fact, a radio-frequency plasma plug usually comprises an essentially inductive upper portion, mainly composed of the plug coil and a casing forming screening of the essentially inductive portion, and an essentially capacitive lower portion mainly composed of a coaxial structure, the assembly behaving like a coaxial line resonator. Now, it is known that the continuity and the quality of the electrical connection between the various components of such a resonator play an important part in the optimization of its performance. Moreover, the dimensions of said elements of the resonator must be defined, according to the range of radio-frequency operation, so as to optimize the performance of the resonator: in particular, the length of the essentially capacitive portion must be as short as possible, in view of the geometrical characteristics of the access thread to the combustion chamber, in order that the capacitance value remains small. In addition, the diameter of the essentially inductive portion must be as large as possible, in order that the magnification value of the resonator thus constituted be optimum. These constraints then involve reviewing the method of production and fitting of the elements of the assembly constituting the resonator previously mentioned.

The object of the present invention is to provide an assembly device in which the connection between the coil and the other elements constituting the plug provides both the electrical continuity and a mechanical coupling, while allowing the assembly thus constituted to be installed without having to slide a tool around the coil to bear on the barrel of the plug.

For this purpose, the invention provides a plug of the type mentioned above, characterized in that the core is elastically deformable so as to compensate for the effects of the expansion of the insulator.

According to other features of the invention, the core is a cylinder with a polygonal section.

According to other features of the invention, the core is a cylinder generated by rotation.

According to other features of the invention, the core is a tube.

According to other features of the invention, the core is a solid cylinder.

According to other features of the invention, the core comprises at one of its ends a recess of axial depth which receives a plug and in that the depth is equal to or more than a defined distance between the end of the core and a first coil of the winding.

According to other features of the invention, the end corresponds to the connection with the central electrode.

According to other features of the invention, the plug is made of high density polymer.

According to other features of the invention, the core is selected from various polymers.

Preferably, but not exclusively, the invention applies to a radio-frequency plasma spark plug.

Other features and advantages of the invention will emerge on reading the description of embodiments with reference to the attached figures.

Identical or similar elements are designated by the same reference numbers.

Figure 1:
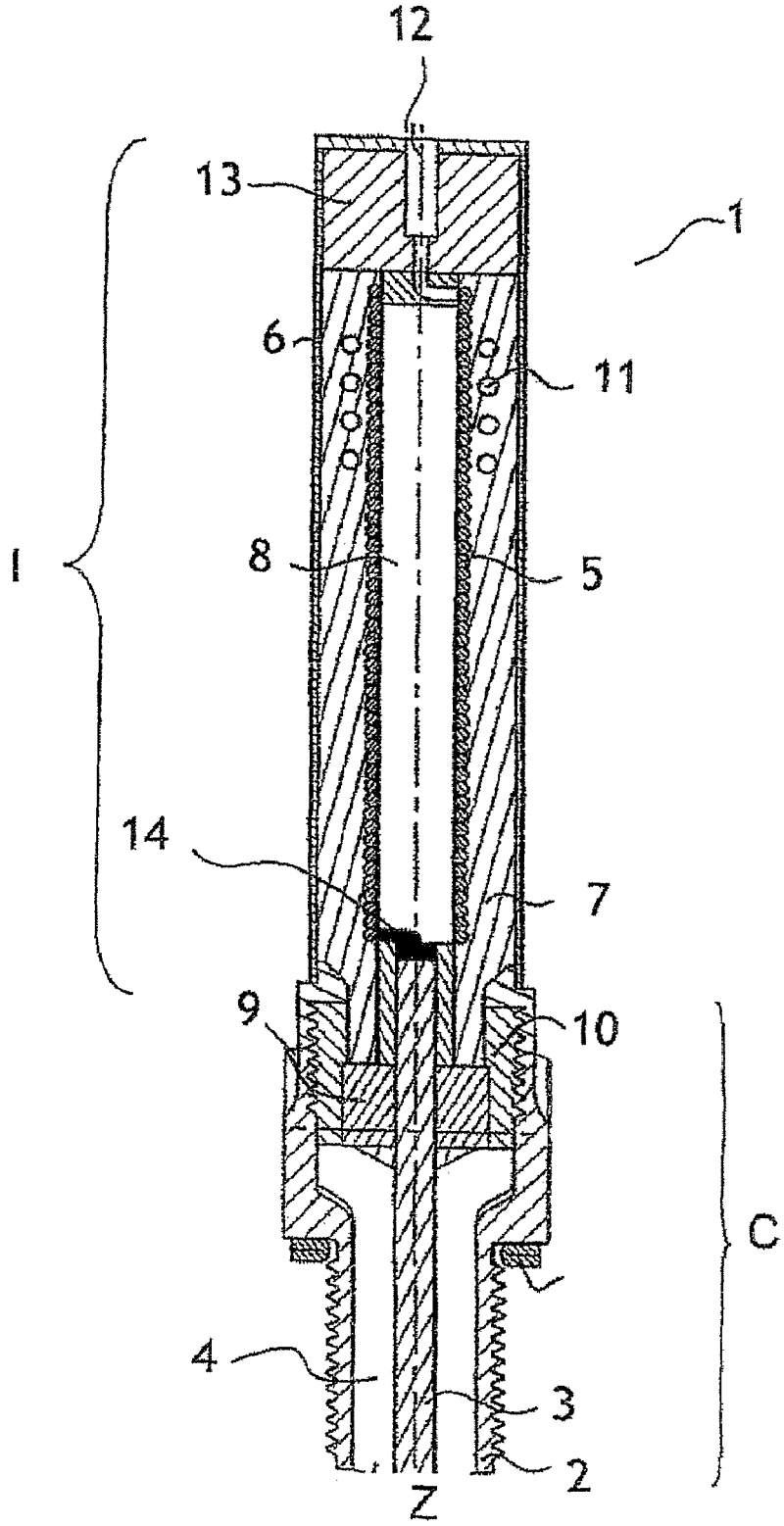
FIG. 1 illustrates a schematic sectional view along the axis Z of a radio-frequency plasma plug according to the invention.

As illustrated in FIG. 1, a radio-frequency plasma plug 1 of essentially cylindrical general shape mainly comprises an essentially capacitive lower portion C and an essentially inductive upper portion I, the portions C and I being of essentially long shape, connected in series and comprising a common longitudinal axis Z.

A method of rigid connection is introduced between certain elements of each of the essentially capacitive C and essentially inductive I portions. The use of materials and shapes allowing the transmission of a tightening torque from the essentially inductive portion I to the essentially capacitive portion C allows the connection between the portions C and I of the plug 1 to be made optimally both from a mechanical point of view and an electrical point of view.

The essentially capacitive portion C comprises, in particular, a barrel 2 intended to be connected to earth and surrounding an essentially cylindrical central electrode 3, with an axis Z, acting as high voltage electrode. An electrically insulating piece, called an "insulator" 4, is placed between the barrel 2 and the central electrode 3, the insulator 4 being configured so as to guide the sparks between the electrodes 2 and 3. In a manner well known in the prior art, the barrel 2 has, on the external face of its lower portion nearest to the cylinder head of the internal combustion engine fitted with the plug 1, an appropriate shape for the installation, support and tightening of the plug 1 in the cylinder head (for example and in a non-limiting manner, as illustrated in FIG. 1: a thread).

The essentially inductive portion I of the plug 1 comprises, for its part, a winding 5 of which the axis is advantageously essentially common with the axis Z of the central electrode 3 and the plug 1. The winding 5 is, moreover, surrounded by a casing 6. It is intended to reduce the electromagnetic emissions of the plug 1 and act as screening. The tightening torque to make the connection between the essentially capacitive portion C and the essentially inductive portion I of the plug 1 is transmitted by the casing 6. The main advantage of this type of transmission is that it concentrates the mechanical constraints at the largest available radius, at the point where the effect of leverage is optimum, thus minimizing the mechanical constraints on the materials themselves. The transmission of the tightening torque from the essentially inductive portion I to the essentially capacitive portion C then amounts to the transmission of a torsional moment from the casing 6 to the barrel 2.

This casing 6 is made from a rigid material, for example a polymer, or a metal.

Where the casing is metallic. According to known industrial methods, the casing 6 can be made from various metallic materials and by various appropriate techniques. It can in particular, for example and in a non-exhaustive manner, be made at the same time as the barrel 2 (by stamping or pressing), or be welded to the barrel 2 after making the two parts separately (stamping of the barrel 2 and drawing/rolling of the casing 6). The internal face of the casing 6 must be coated with a layer a few dozen microns thick (typically 30 to 50 μm, for example of a material smith high electrical conductivity (for example and in a non-limiting manner: silver or copper), this, in order to improve the radio-frequency conductivity of the casing 6 and limit the losses by a film effect inside it. The transmission of the tightening torque (torsional moment here) from the essentially inductive portion I to the essentially capacitive portion C of the plug is obtained by the rigid metallic connection made, during manufacture, between the casing 6 and the barrel 2, by one of the means previously described (simultaneous manufacture of the casing and the barrel by stamping or pressing, or separate manufacture, then rigid assembly of the casing 6 and the barrel 2, for example by welding).

Where the casing is made from a polymer-type insulating material. These materials have a lower mechanical rigidity than metallic materials, so the casing 6 must be relatively thick (essentially, and as an example, of the order of a few millimeters) so as to be able to allow the transmission of the tightening torque to the barrel 2. In order to provide the screening function of the essentially inductive portion, the external face of the casing 6 must be coated with a layer a few dozen microns thick (typically and as a non-limiting example: 30 to 50 μm) of a material with a high electrical conductivity (for example and in a non-limiting manner: silver or copper). The application of this coating to the external face of the casing 6 slightly increases the external diameter of the essentially inductive portion I, which improves the magnification of the resonator composed of the portions C and I. The transmission of the tightening torque between the essentially portion I and the essentially capacitive portion C of the plug 1 is obtained by appropriate shaping of the interface between the barrel 2 and the casing 6 as describe in the unpublished patent application FR 0,452,790.

The dimensions of the casing 6 are calculated so as to minimize the risk of arcing between the winding 5 and the casing 6. Advantageously, in order to further reduce the risk of arcing, source of unwanted energy dissipation, an insulator 7 is placed between the winding 5 and the casing 6, and the winding 5 is made round the core 8. In the embodiment of the radio-frequency plasma plug presented in FIG. 1, a complementary insulator 9 is also placed between the insulator 7 and the insulator 4 separating the barrel 2 and the central electrode 3, a part 10 electrically connected to the barrel 2, providing the connection between the support of the insulators 4, 7, and 9.

The materials and embodiments and methods of assembly of these various elements are defined and used so as to limit as far as possible any inclusion of air at the interfaces, also sources of arcing and losses.

A current measurement winding 11 is also usually made round the winding 5, and a connection device 13, connected to a connector 12 (not shown in detail in the figures), is placed at the upper end of the plug 1. The upper coil 52 of the winding 5 is connected to the connector 12, the lower coil 51 of the winding 5 being connected by appropriate means 14 (not shown in detail in the figures) at one internal end of the central electrode 3.

In order to reduce unwanted capacitances as far as possible (as has been mentioned above, the smaller the capacitance value of the capacitive portion, the better the performance of the resonator thus constituted), the length of the connection between the essentially capacitive portion C and the essentially inductive portion I must be as short as possible. Similarly, the larger the diameter of the essentially inductive portion I, the better the magnification of the coaxial line resonator constituted by the essentially inductive portion I and the essentially capacitive portion C placed in series. Anyway, the electrical quality of the connection between the essentially capacitive C and inductive I portions (electrical continuity, in particular) must also be the best in order to optimize the performance of the resonator.

Figure 2:
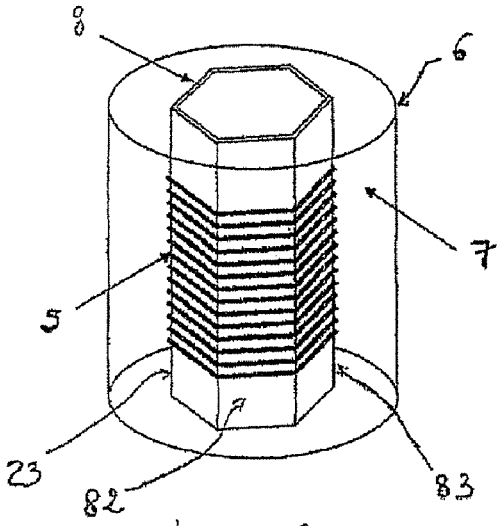
FIG. 2 illustrates a schematic perspective view of an insulator placed between a casing and a cylindrical core with an elastically deformable polygonal section of a radio-frequency plasma plug according to a first embodiment of the invention.
Figure 3:
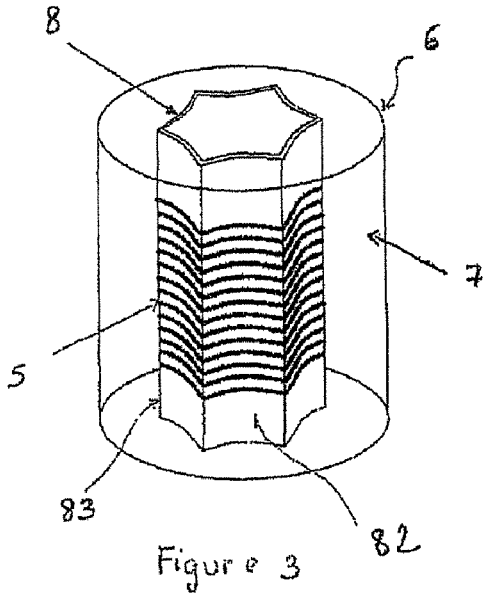
FIG. 3 illustrates a schematic perspective view of an insulator placed between a casing and a deformed polygonal section cylindrical core of a radio-frequency plasma plug according to a first embodiment of the invention.

According to a first embodiment, the core 8 is a tube with an elastically deformable polygonal section. As illustrated in FIG. 2, the tube has a hexagonal section. The thickness of each of the axial walls or faces 82 is dimensioned so that the axial walls or faces 82 are able to deform elastically. For example, the axial walls or faces 82 can have a thickness of between 0.2 and 0.5 mm. The insulator 7 placed between the winding 5 and the casing 6 can be selected from incompressible fluids or solids having a large coefficient of expansion with temperature, for example and in a non-limiting manner, silicone. In that case, the axial walls or faces 82 can deform elastically so as to compensate for the effects of the expansion of the insulator 7. During this deformation, the axial walls or the axial faces 82 can curve inward radially toward the interior of the tube and the axial edges 83 retain an essentially identical position allowing the winding to retain essentially the same winding position round the core 8, as illustrated in FIG. 3.

Figure 4:
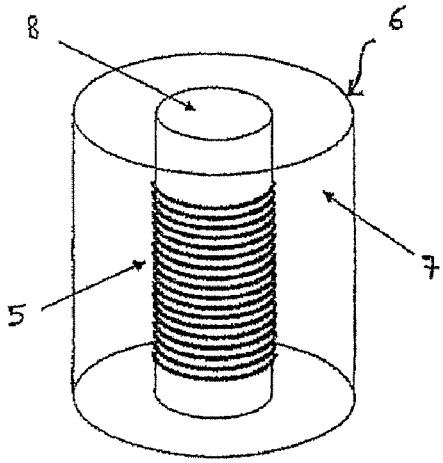
FIG. 4 illustrates a schematic perspective view of an insulator placed between a casing and an elastically deformable cylindrical core generated by rotation of a radio-frequency plasma plug according to a second embodiment of the invention.
Figure 5:
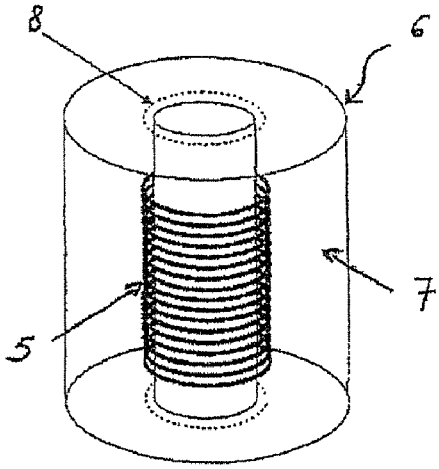
FIG. 5 illustrates a schematic perspective view of an insulator placed between a casing and a deformed cylindrical core generated by rotation of a radio-frequency plasma plug according to a second embodiment of the invention.

According to a second embodiment, the core 8 is a solid cylinder with an elastically deformable polygonal section. As illustrated in FIG. 4, the solid cylinder has a cylindrical section. The core 8 is selected from compressible materials such as polymers (for example: polymer foam, expanded polymer). The insulator 7 placed between the winding 5 and the casing 6 can se selected from incompressible fluids or solids having a large coefficient of expansion with temperature, for example and in a non-limiting manner, silicone. In that case, the core 8 can deform by a reduction of its volume so as to compensate for the effects of the expansion of the insulator 7, as illustrated in FIG. 5.

In the embodiments described, the materials usually selected have a low density. This results in a weight reduction of the winding/plug assembly and therefore a great improvement from the point of view of the inertia of the parts when vibrating.

Figure 6:
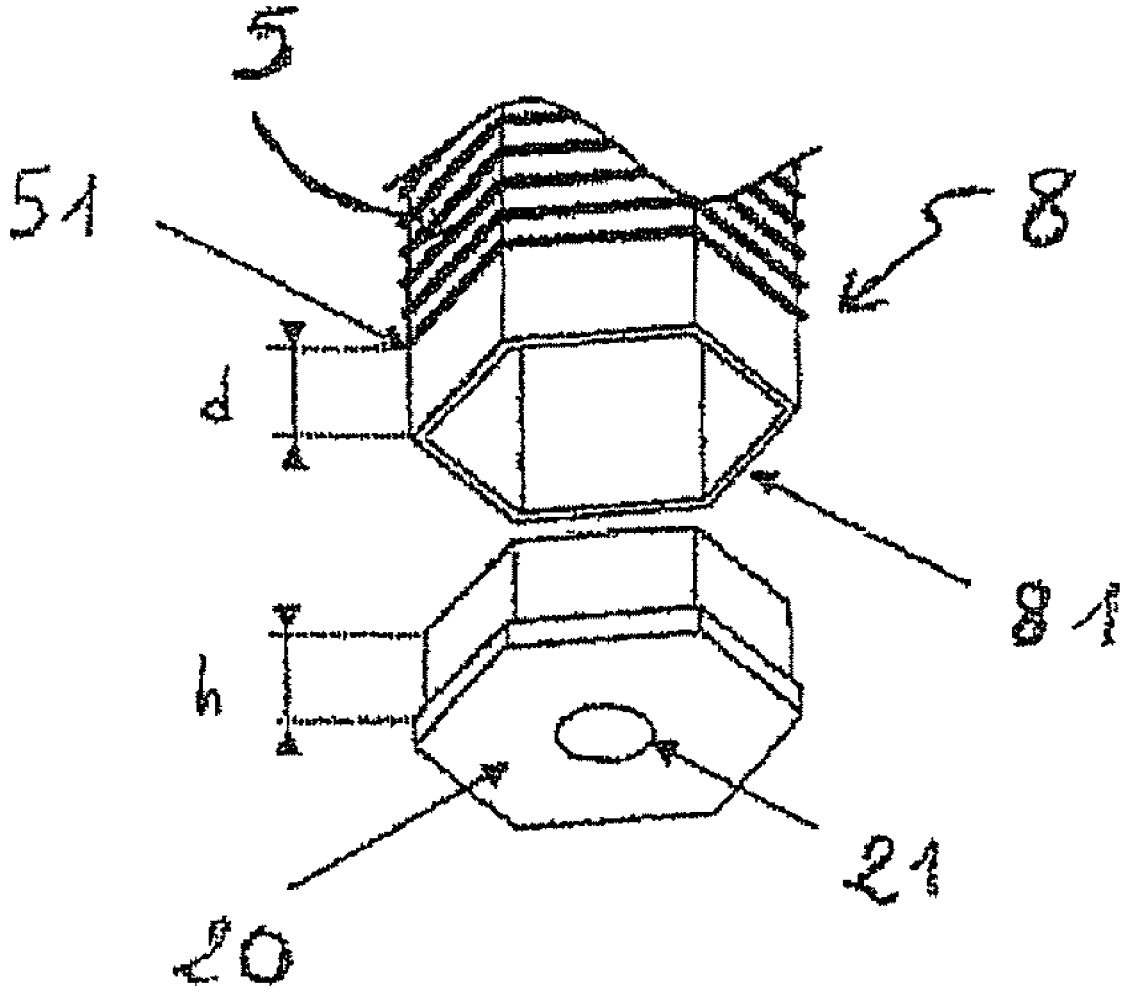
FIG. 6 illustrates a schematic perspective view of an insulator placed between a casing and a core which is cylindrical with a polygonal section, elastically deformable and comprising a plug, of a radio-frequency plasma plug according to the invention.

In the embodiments previously described, as illustrated in FIG. 6, so as to prevent electrical leaks at the means 14 connecting the lower coil 51 of the winding 5 and the central electrode 3. For that purpose, the core 8 comprises at one of its ends 81 a recess of axial depth h which receives a plug 20. In addition, the depth h is equal to or more than a defined distance d between the end 81 of the core 8 and the lower coil 51 of the winding 5. In addition, the plug 20 is dimensioned so as to provide the mechanical support and the concentricity between the core 8 and the central electrode 3, the core 8 comprises, at its end 81, the plug 20 with a hole 21 cut through it so that at least the head of the central electrode 3 passes through this hole 21. The plug 20 can be made of high density polymer such as polyethylene.

In all the embodiments previously described, the electrical continuity of the assembly of the plug 1 according to the invention is finally determined by the connection element 13 intended for the connection of the connector 12 to the electric power supply of the plug 1.

Advantageously, the element 13, rigidly connected, in particular to the casing 6 (for example and in a non-limiting manner, by one of the means of the type of those which have just been described for the connection of the casing 6 with the barrel 2), has a shape which is suitable for the use of a simple tightening tool for the installation and the tightening of the plug 1 in the cylinder head of the engine.

It thus appears that a spark plug 1 according to the invention can be installed and removed from its access well without having to slide a special tool around the plug: it is therefore not necessary to arrange, in the plug 1 access well, a space required for the passage of the special tool used only for the plug fitting and removal operations.

It should be noted that the principle of a connection which is both mechanically rigid and electrically sound between the two portions of a spark plug 1 (the plug itself and its winding), here described in its application to a radio-frequency plasma plug, and preferably intended for this type of plug, can be applied to any type of conventional plug.

The invention claimed is:

1. A spark plug for an internal combustion engine of a motor vehicle, of essentially long general shape, comprising:

an essentially capacitive lower portion comprising first and second coaxial electrodes, the first coaxial electrode being a central electrode and the second coaxial electrode being a threaded barrel for screwing the spark plug into the engine;

an essentially inductive upper portion comprising a central winding that comprises plural coils wound around a coaxial core, a casing, and an insulator placed between the casing and the winding;

the essentially capacitive portion and the essentially inductive portion being connected together mechanically so as to allow transmission of a tightening torque applied at the casing to the essentially capacitive lower portion, wherein the core is elastically deformable so as to compensate for effects of expansion of the insulator.

2. The spark plug as claimed in claim 1, wherein the core is a cylinder with a polygonal section.

3. The spark plug as claimed in claim 2, wherein the core is a cylinder generated by rotation.

4. The spark plug as claimed in claim 2, wherein the core is a tube.

5. The spark plug as claimed in claim 2, wherein the core is a solid cylinder.

6. The spark plug as claimed in claim 1, wherein the core comprises at one of its ends a recess of axial depth that receives a plug, and wherein the axial depth is equal to or more than a defined distance between the end of the core and a first coil of the winding.

7. The spark plug as claimed in claim 6, wherein the end corresponds to a connection with the central electrode.

8. The spark plug as claimed in claim 6, wherein the spark plug is made of high density polymer.

9. The spark plug as claimed in claim 1, wherein the core is made of at least one polymer.

* * * * *